US009392664B2

(12) United States Patent
Frost et al.

(10) Patent No.: US 9,392,664 B2
(45) Date of Patent: Jul. 12, 2016

(54) LED LIGHTING DEVICE AND METHOD FOR OPERATING AN LED LIGHTING DEVICE

(75) Inventors: Tobias Frost, Burglengenfeld (DE); Bakuri Lanchava, Regensburg (DE)

(73) Assignee: OSRAM GmbH, Munich (DE)

( * ) Notice: Subject to any disclaimer, the term of this patent is extended or adjusted under 35 U.S.C. 154(b) by 144 days.

(21) Appl. No.: 13/578,795

(22) PCT Filed: Jan. 20, 2011

(86) PCT No.: PCT/EP2011/050781

§ 371 (c)(1),
(2), (4) Date: Aug. 13, 2012

(87) PCT Pub. No.: WO2011/098334

PCT Pub. Date: Aug. 18, 2011

(65) Prior Publication Data

US 2012/0306379 A1 Dec. 6, 2012

(30) Foreign Application Priority Data

Feb. 12, 2010 (DE) ..... 10 2010 001 889
Apr. 30, 2010 (DE) ..... 10 2010 028 406

(51) Int. Cl.
*H05B 37/02* (2006.01)
*H05B 33/08* (2006.01)

(52) U.S. Cl.
CPC ..... *H05B 33/0869* (2013.01)

(58) Field of Classification Search
USPC ..... 315/360, 307, 151, 291
See application file for complete search history.

(56) References Cited

U.S. PATENT DOCUMENTS

| | | | | |
|---|---|---|---|---|
| 6,208,446 | B1 * | 3/2001 | Faifman | 398/136 |
| 6,445,139 | B1 * | 9/2002 | Marshall et al. | 315/291 |
| 6,630,801 | B2 * | 10/2003 | Schuurmans | 315/307 |
| 6,798,152 | B2 | 9/2004 | Rooke et al. | |
| 6,825,927 | B2 * | 11/2004 | Goldman et al. | 356/317 |
| 7,329,998 | B2 * | 2/2008 | Jungwirth | 315/291 |
| 7,388,665 | B2 * | 6/2008 | Ashdown | G01J 3/10 250/226 |
| 7,615,939 | B2 * | 11/2009 | Halter | 315/307 |
| 8,521,035 | B2 * | 8/2013 | Knapp et al. | 398/172 |

(Continued)

FOREIGN PATENT DOCUMENTS

| | | |
|---|---|---|
| CN | 101331798 | 12/2008 |
| DE | 699 06 260 | 6/2000 |

(Continued)

*Primary Examiner* — Douglas W Owens
*Assistant Examiner* — Syed M Kaiser
(74) *Attorney, Agent, or Firm* — Cozen O'Connor

(57) ABSTRACT

A method for operating an LED lighting device (L), wherein the LED lighting device comprises: at least two color channels (Ch1, Ch2, Ch3), wherein each color channel (Ch1, Ch2, Ch3) comprises at least one LED (LD1, LD2, LD3), wherein the LEDs (LD1, LD2, LD3) of a color channel (Ch1, Ch2, Ch3) each have the same color, and wherein each color channel (Ch1, Ch2, Ch3) is able to be activated separately, and at least one photodetector (D), which is configured and arranged to detect a portion of the light radiated by the LEDs (LD1, LD2, LD3), wherein the method comprises the steps of: switching over the LED lighting device (L) from an operating phase (BP 1) into a measurement phase (MP); and temporally consecutive activation of the color channels (Ch1, Ch2, Ch3) so that a light radiated during the measurement phase (MP) by the LEDs (LD1, LD2, LD3) has an integral mixture which substantially corresponds to a color mixture of the operating phase.

18 Claims, 2 Drawing Sheets

(56) References Cited

U.S. PATENT DOCUMENTS

| | | | | |
|---|---|---|---|---|
| 2002/0047624 | A1 | 4/2002 | Stam et al. | |
| 2002/0097000 | A1 | 7/2002 | Muthu et al. | |
| 2004/0036418 | A1 | 2/2004 | Rooke et al. | |
| 2006/0006821 | A1 | 1/2006 | Singer et al. | |
| 2008/0065345 | A1* | 3/2008 | Ooghe | 702/130 |
| 2008/0208020 | A1* | 8/2008 | Cinbis et al. | 600/323 |
| 2008/0297066 | A1* | 12/2008 | Meijer et al. | 315/291 |
| 2009/0185027 | A1* | 7/2009 | Cox et al. | 348/36 |
| 2010/0277711 | A1* | 11/2010 | Shih et al. | 356/4.01 |
| 2011/0043137 | A1* | 2/2011 | Negley et al. | 315/297 |
| 2011/0059016 | A1* | 3/2011 | Ramanujam et al. | 424/9.1 |
| 2011/0116046 | A1* | 5/2011 | Haeri | A61B 3/0008 351/221 |
| 2012/0134155 | A1* | 5/2012 | Wendt et al. | 362/249.03 |
| 2012/0306379 | A1* | 12/2012 | Frost et al. | 315/151 |

FOREIGN PATENT DOCUMENTS

| | | |
|---|---|---|
| DE | 10 2005 049 579 | 4/2007 |
| EP | 1 898 677 | 3/2008 |
| JP | 2007-286359 | 11/2007 |
| JP | 2008-123818 | 5/2008 |
| JP | 2008-210853 | 9/2008 |
| JP | 2009-129688 | 6/2009 |
| WO | WO 02/23954 | 3/2002 |
| WO | WO 2006/063552 | 6/2006 |
| WO | WO 2008/029548 | 3/2008 |

* cited by examiner

LED LIGHTING DEVICE AND METHOD FOR OPERATING AN LED LIGHTING DEVICE

RELATED APPLICATIONS

This application is a U.S. National Phase Application under 35 USC 371 of International Application PCT/EP2011/050781 filed Jan. 20, 2011.

This application claims the priority of German application No. 10 2010 001 889.9 filed Feb. 12, 2010 and 10 2010 028 406.8 filed Apr. 30, 2010, the entire content of both of which are hereby incorporated by reference.

FIELD OF THE INVENTION

The invention relates to a method for operating an LED lighting device and to an LED lighting device.

BACKGROUND OF THE INVENTION

WO 2006/063552 A1 relates to a motor vehicle headlamp element having at least one light emitting diode (LED) and at least one control facility which is suitable for processing a signal dependent on a measured value and to inject a current in accordance with the signal into the light emitting diode, wherein the control facility and the light emitting diode are arranged on a common carrier.

US 2004/0036418 A1 relates to a circuit and to a method for providing a closed control circuit using continuous current switching techniques. By means of controlling the current which is supplied to the light emitting diodes (LEDs), the LEDs are able to be operated with or close to their maximum capacity without the danger of overloading the LEDs or of disproportionate amounts of current being used. A circuit has a number of high-side switches of which each is connected to an LED array. The LED arrays are connected via a coil to a current switching operating point which switches current to ground or feeds the current back again in order to maintain an LED current flow in a desired area.

US 2006/0006821 A1 relates to a system and method for implementing an LED-based lamp which contains one or more color channels. The lamp comprises a controller which uses optical scanning and feedback to control LEDs in each channel so that they provide a full-range luminous intensity and/or color output. The optical feedback loop is designed to provide the light controller with an even luminous intensity and/or color of the light output. The controller is then designed to set a current and/or a pulse width modulation (PWM) duty cycle which will be fed to separate color channels of the lamp in order to obtain the desired luminous intensity and/or color.

US 2002/0097000 A1 relates to an LED lighting system to provide power for LED light sources in order to provide a desired light color, which has a power supply stage which is designed to provide a direct current signal. A light mixing circuit is coupled to the power supply stage and comprises a plurality of LED light sources with red, green and blue color, in order to generate light with different desired color temperatures. A control system is coupled to the power supply stage and is designed provide control signals to the power supply stage in order to hold the direct current signal at a desired level in order to maintain the desired light output. The control system is further designed to estimate associated lumen output components for the LED light sources and to do this is based on a transition temperature of the LED light sources and chromaticity coordinates of the desired light to be generated at the light mixing circuit. The light mixing circuit also has a temperature sensor for measuring the temperature associated with the LED light sources and a light detector for measuring a lumen output level of light generated by the LED light sources. Based on the measured temperatures the control system determines the quantity of output lumens that each of the LED light sources must generate in order to achieve the desired mixed light output, and the light detector in conjunction with a feedback loop maintains the required lumen output for each of the LED light sources.

DE 10 2005 049 579 A1 relates to a light source which radiates mixed-color light containing light of at least two different colors, which is radiated by a plurality of primary light sources in which the primary light sources are divided up into groups and the brightness values of the primary light sources within a group are determined and controlled separately according to color, so that the color location of the mixed-color light lies in a predetermined range of the standard color table. Furthermore a method for controlling such a light source is specified as well as a lighting device with such a light source, for backlighting a display for example.

SUMMARY OF THE INVENTION

One object of the present invention is to provide an especially user-friendly option for adjusting an LED lighting device with at least two color channels.

One aspect of the present invention is directed to a method for operating an LED lighting device, wherein the LED lighting device has at least the following features:

- at least two color channels, especially of different colors, with each color channel comprising at least one light emitting diode (LED) of the same color, and wherein each color channel is able to be controlled separately or individually, and
- at least one photo detector, which is configured and arranged to detect a portion of the light emitted by the LEDs, wherein the method has at least the following steps:
- switching the LED lighting device from an operating phase to a measurement phase;
- temporally successive (sequential) control or activation of the color channels so that a light radiated during the measurement phase of the LEDs has an (integral) color mixture which substantially corresponds to a color mixture of the operating phase.

The at least two color channels can also include different color channels of the same color. Each color channel includes one or more LEDs of the same color, e.g. connected in series or in parallel.

By means of the at least one photodetector, especially a single photodetector, a portion or fraction of the light radiated from the (especially all) LEDs is detected or sensed. The photodetector can for example comprise a photodiode or a phototransistor.

The operating phase corresponds to normal operation of the LED lighting device.

A color mixture or integral color mixture of the measurement phase can especially be understood as an addition of the light of the color channels radiated during the measurement phase. The sequence of the temporally successively controlled color channels is basically not restricted, the sequence of the temporally successively controlled color channels can be the same for a number of measurement phases or can differ.

The above method has the advantage that the temporally successive (sequential) control of the color channels of the luminous flux detected by the photodetectors are able to be uniquely and highly accurately assigned to a specific color channel. This does away with any outlay for fault-prone separation or reconstruction of the luminous fluxes of the individual color channels. This can be used for example to define a correlation between a current through a color channel and the resulting luminous intensity or luminous flux of this color channel. Thus a desired color location and/or a desired luminous intensity can be set or controlled more accurately in turn during the operating phases for example.

The fact that a light radiated during the measurement phase from the LEDs has a color mixture which substantially corresponds to a color mixture of the operating phase means that a color impression of the previous operating phase is maintained simultaneously, so that an observer cannot distinguish the measurement phase in color terms from the operating phase and thus the measurement phase cannot be perceived as irritating.

One embodiment is that during the measurement phase each color channel is controlled separately by means of a pulse width modulation so that a ratio of pulse widths of the color channels during the measurement phase essentially corresponds to a ratio of pulse widths of the color channels during the operating phase. The same color impression as in the operating phase is thus achieved by setting a similar or same pulse width, which is especially easy to do.

An especially advantageous embodiment for generating the same or a similar color impression is that a deviation of a ratio of the pulse widths of two color channels during the measurement phase does not differ by more than 10%, especially not more than 1% from the ratio of the pulse widths of these two color channels during the operating phase.

An alternative or additional embodiment is that a current level for each of the color channels is set separately so that a ratio of current levels of the color channels during the measurement phase substantially corresponds to a ratio of current levels of the color channels during the operating phase. This enables the same or a similar color impression of operating phase and measurement phase to be achieved by adhering to the current level conditions, if for example the color channels are controlled in long-term operation.

A development is that an amount of light during the measurement cycle is brought to a value by setting the current level at which a signal level of a sensor signal of the at least one photodetector lies in a range between 75% and less than 100%, e.g. 99.5% of its maximum signal level. This enables on the one hand by a sufficiently high signal level with a high signal-to-noise ratio (SNR) to be reached and simultaneously a saturation of the photodetector to be avoided.

An advantageous embodiment for quickly setting the level of the sensor signal in the range between 75% and less than 100% of its maximum signal level is that the amount of light is brought by a search algorithm to the value or into the range. The search algorithm can be a linear search algorithm for example. For fast setting of the level a search algorithm can be used, which operates more quickly than the linear search algorithm, especially a binary search algorithm or an interval search.

For example it can be desirable to reduce the level of the sensor signal if a lot of light is reflected back into the photodetector and/or is radiated in from the environment. This can be a case for example if a light mixer such as for example a diffuser, a beam-forming optic etc. is connected downstream from the LED lighting device, which throws back a comparatively large amount of light. The photodetector can be saturated by this, so that no meaningful correlation between a control signal of a color channel and its luminous flux is produced any longer in the measurement phase.

A further embodiment is that the measurement phase, in addition to the step of controlling the color channels, has a step of not activating all color channels. In this 'dark phase' an effect on the sensor signal of the ambient incident light into the LED lighting device can be determined.

A further embodiment is that the measurement phase additionally has compensation sections during which the color channels are controlled as during an operating phase. Thus the color channels can also be operated simultaneously during the compensation sections. This enables an impression of brightness during the measurement phase to be tailored for a user to an impression of brightness during an operating phase.

If, as a result of the different lengths of on times or activation periods of the individual channels, more measurements can be carried out than are necessary for regulation, in subsequent measurement phases these measurements can be omitted or explicitly shortened in order to reduce the time required for the measurement phase. In this embodiment the errors caused by the omitted measurements can be corrected for example by the compensation sections.

For an integral color mixing in which the sequential control of the color channels is perceived by a user because of the eye's inertia as a simultaneous light radiation, an advantageous embodiment is that a measurement phase does not last longer than around 40 ms, especially not longer than 20 ms, especially not longer than 10 ms. In particular a duration of the measurement phase in which a color channel is controlled can last as long as is necessary for detecting the measured values of the individual channels, thus even without a dark phase for example.

A further embodiment is that the period of time between two measurement phases is not constant. This enables the situation to be suppressed in which a number of LED lighting devices, especially a number of times consecutively, are simultaneously (collectively) in their measurement phase and thus give the user a greater impression of a difference from an operating phase. This effect can be suppressed especially effectively if a period of time between two measurement phases is specified non-deterministically, e.g. in a random or pseudo-random manner.

A further embodiment is that a sensor signal output during the measurement phase by the at least one photodetector is used at least in sections to adapt control in a following operating phase. This can occur for example in the form of feedback. For example the result can be used in order to calculate and/or adjust the amount of light needed for achieving the color location.

It is advantageous to activate the color channels in the measurement phase in the sequence of brightness of the color channels, preferably in a descending sequence. If the brightness is adapted by activation of the current source, the period of time that the current source needs in order to achieve the desired power value is decisive for the duration of the measurement. Depending on the power source this can be different in rise or in fall. It has proved advantageous to select the "slow" step at the start of the measurement and then follow the "fast" direction for the adaptations in the individual steps.

Most power sources make a rapid power and thus dielectric strength reduction possible but only a slow increase. Thus it is especially advantageous to activate the color channels in descending order of brightness, i.e. initially the color channel with the greatest brightness, then with the second greatest etc., through to the channel with the lowest brightness. The dark phase is then advantageous as a conclusion if such a phase is provided. This produces an especially rapid measurement and thus a short measurement phase which minimizes the danger of visible brightness fluctuations arising for an observer.

Another aspect of the invention is directed to an LED lighting device, wherein the LED lighting device has at least the following features:

- at least two color channels, especially of different colors, with each color channel comprising at least one LED of the same color and wherein each color channel is able to be controlled separately,
- at least one photodetector, which is configured and arranged to detect a portion of the light radiated by the LEDs,
- a switchover device for switching over the LED lighting device from an operating phase into a measurement phase and
- a measurement phase schedule which is configured to control the color channels consecutively so that a light radiated by the LEDs during the measurement phase has an integral color mixture which substantially corresponds to a color mixture of the operating phase.

The switchover device can for example be a functional part of a general control device of the LED lighting device.

A development is that the LED lighting device is configured to execute a method as described above.

BRIEF DESCRIPTION OF THE DRAWINGS

In the figures below the invention will be described schematically in greater detail with reference to an exemplary embodiment.

DETAILED DESCRIPTION OF THE DRAWINGS

Figure 1:
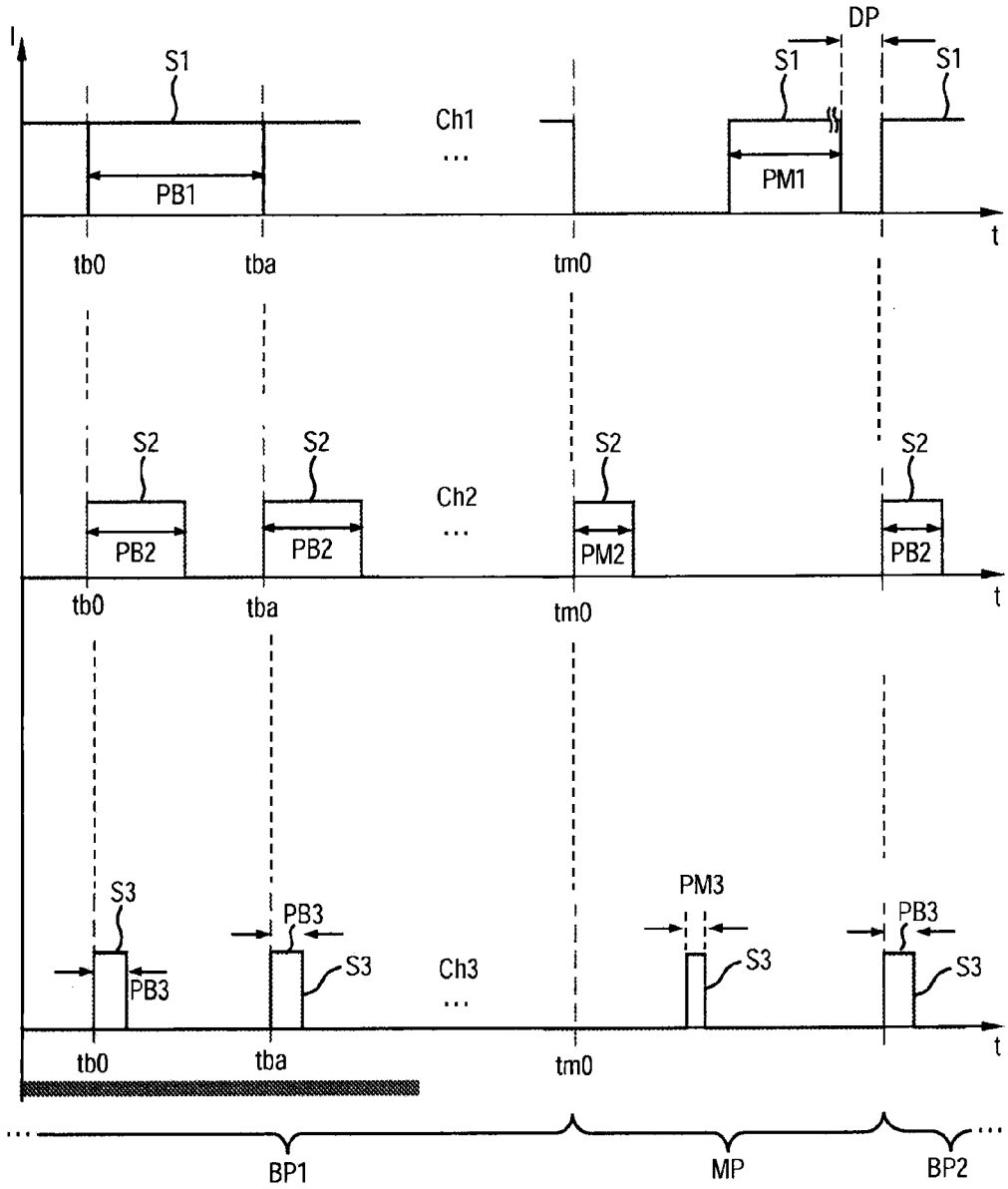
FIG. 1 shows in each of three rows a section of a first, a second or a third control signal for a respective associated color channel of an LED. The control signal is shown in each case as an application of a current level of a current I injected into the respective color channel plotted against the time T.

The first row from FIG. 1 shows a section of a first control signal Si for a first color channel Ch1 of LED lighting device. The first color channel Ch1 contains all light emitting diodes (LEDs) of a first color, e.g. red, which are controlled together by means of the common control signal Si. The red light emitting diodes of the first, red color channel Ch1 can be connected in series for example.

The second row shows a section from a second control signal S2 for a second color channel Ch2 of an LED lighting device. The second color channel Ch2 contains all light emitting diodes (LEDs) of a second color, e.g. green, which are controlled by means of the common control signal S2. The green light emitting diodes of the second, green color channel Ch2 can be connected in series for example.

The third row shows a section from a third control signal S3 for a third color channel Ch3 of an LED lighting device. The third color channel Ch2 contains all light emitting diodes (LEDs) of a third color, e.g. blue, which are controlled by means the common control signal S3. The blue light emitting diodes of the third, blue color channel Ch3 can be connected in series for example.

FIG. 1 shows in each case contemporaneous sections of the control signals S1, S2 or S3 respectively. The sections each show a first operating phase BP1, which is followed by measurement phase MP, which is followed by a second operating phase BP2.

In the operating phases BP1, BP2 the LED lighting device is operated normally. The operating phases BP1, BP2 consist of a sequence of activation cycles of duration tba, of which an activation cycle is shown for example in the first operating phase BP1 between a point in time tb0=0 and a point in time tba.

In the activation cycle shown in the figure all three color channels Ch1, Ch2, Ch3 are initially controlled or activated simultaneously as from the point in time tb0, but mostly for a different duration within the activation cycle. In other words a pulse, especially a current pulse, is issued to all three color channels Ch1, Ch2, Ch3 in an activation cycle, wherein a pulse width PB1, PB2, PB3 of the color channels Ch1, Ch2, Ch3 can differ. The pulse width PB1, PB2, PB3 is able to be adjusted by the LED lighting device and can be aligned for example to a desired color temperature. Thus a specific color or color location of the light radiated by the LED lighting device, e.g. warm white or cold white, can be assigned a specific ratio of the pulse widths PB1, PB2, PB3 and thus activation periods of the color channels Ch1, Ch2, Ch3. This makes use of the fact that the duration tba of an activation cycle is so short that, because of the inertia of an eye, the light radiated by all color channels Ch1, Ch2, Ch3 is perceived by an observer as light radiated practically simultaneously, i.e. as mixed light from the three color channels Ch1, Ch2, Ch3.

In the typical activation cycle shown in the figure the LEDs of the first color channel Ch1 have power permanently applied to them, which corresponds to a pulse width PB1 of 100% of the activation cycle, i.e. PB1=tba. The LEDs of the second color channel Ch2 are supplied with power for 55% of the time of the activation cycle (PB2=55% tba), and the LEDs of the third color channel Ch3 are supplied with power for 18% of the time of the activation cycle (PB3=18% tba). The pulse widths PB1, PB2 or PB3 can for example depend on the desired color location of the LED lighting device, the luminous intensity, the color and the number of the LED(s) per color channel etc. The pulse widths PB1, PB2, PB3 can be varied, e.g. in order to change a color location and/or a luminous intensity of the mixed light.

In the example shown the three color channels Ch1, Ch2, Ch3 can be activated independently of one another, so that e.g. a simultaneous control, especially application of power to the three color channels, is able to be achieved especially easily. However a sequential control can also be used in which no two color channels Ch1, Ch2, Ch3 are activated simultaneously.

Only two color channels might also be used, e.g. with red LED(S) or with green LED(s), for creating a white mixed light. More than three color channels can also be used, e.g. additional channels with amber LED(s) for creating a warm white mixed light.

A portion of the light radiated by the LEDs of the color channels Ch1, Ch2, Ch3 is captured by means of at least one photodetector. The at least one photodetector is at least able to detect a luminous flux of the LEDs and output a corresponding sensor signal, e.g. to an evaluation logic of the LED control device.

At a point in time tm0 the operating phase BP1 changes for all three color channels Ch1, Ch2, Ch3 into the measurement phase MP. In the measurement phase MP the three color channels Ch1, Ch2, Ch3 are activated consecutively or sequentially and not simultaneously. This enables the sensor signal of the at least one photodetector to be assigned simply and uniquely to a specific color channel Ch1, Ch2, Ch3 and evaluated, e.g. for determining and/or setting the luminous intensity or the color location of the mixed light.

So that the measurement phase MP is not obvious to an observer, a time for activating the color channels Ch1, Ch2, Ch3 preferably does not last longer than 40 ms, especially no more than 20 ms, especially no more than 10 ms. It is especially preferred for the total duration tm of the measurement phase MP not to last more than 40 ms, especially not more than 20 ms, especially not more than 10 ms.

In order not to change the color impression for an observer during the measurement phase MP compared to the preceding operating phase BP1, the color channels Ch1, Ch2, Ch3 are controlled so that, during the measurement phase, light radiated by the LEDs has an integral color mixture, which substantially corresponds to a color mixture of the operating phase. An integral color mixture here can especially be understood as an accumulation, especially addition, of the light radiated by the LEDs during the measurement phase. To this end, in this exemplary embodiment, a ratio of the pulse widths PM1, PM2, PM3 of the color channels Ch1, Ch2, Ch3 during the measurement phase MP substantially corresponds to a ratio of the pulse widths PB1, PB2, PB3 of the color channels Ch1, Ch2, Ch3 during the operating phase BP1, even if their absolute width or duration in the measurement phase MP and the preceding operating phase BP1 does not need to match. Because of the inertia of the eye an observer then perceives the same color impression in the measurement phase MP as in the operating phase BP1.

The LED lighting device can establish from the sensor signals for example for each of the color channels Ch1, Ch2, Ch3 a correlation between an associated control signal S1, S2, S3, e.g. a current, and a color-specific luminous intensity and, on deviation from a setpoint value, e.g. of the luminous intensity, can modify the control signal accordingly. Thus for example, if it is established that a luminous intensity for a specific color channel Ch1, Ch2, Ch3 is lower than the stored value of the luminous intensity for the pulse width PM1, PM2, PM3, the pulse width PB1, PB2, PB3 is increased for this color channel Ch1, Ch2, Ch3 in a following operating phase BP2. A lower luminous intensity can occur for example through an ageing of the LEDs, temperature effects or through a failure of an LED.

In the measurement phase MP shown in the figure, the section in which the color channels, Ch1, Ch2, Ch3 are sequentially controlled or activated is followed by an optional section during which none of the color channels is activated, known as a dark phase DP. In the dark phase DP a black value can be removed from the measurement, which for example takes account of ambient light radiated into an LED device, especially the photodetector.

After the measurement phase MP a switch is made to a second operating phase BP2 in which the control signals S1, S2, S3, by comparison with the control signals S1, S2, S3 of the first operating phase BP1, can be modified on the basis of knowledge obtained from the first measurement phase MP.

The time interval between two measurement phases MP can be predefined, e.g. a measurement phase MP can be carried out every n activation cycles. However it can occur, when the number of LED lighting devices which are switched on simultaneously for example are used, that the measurement phases MP of the number of LED lighting devices occur substantially simultaneously or only slightly offset in time. Then an observer can possibly collectively perceive these measurement phases MP. To suppress the perception of the measurement phases MP of a number of LED lighting devices, the time spacing (interval) between two measurement phases MP of an LED lighting device can be non-deterministic, for example random or pseudo-random, especially within a predetermined time interval.

Figure 2:
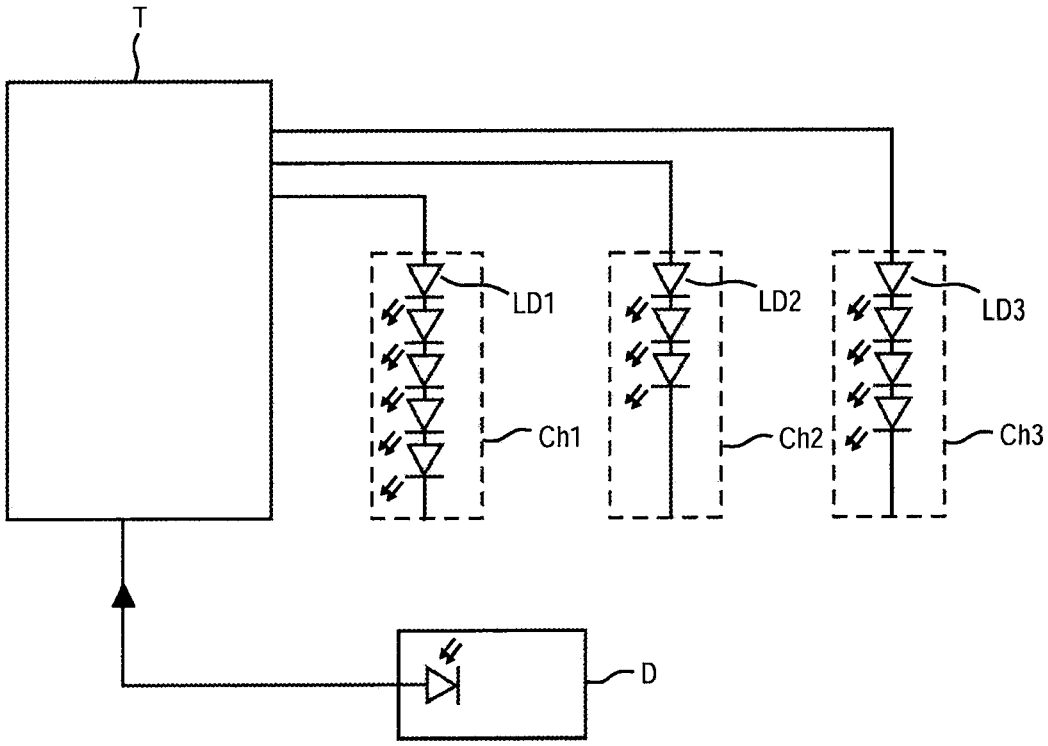
FIG. 2 shows an embodiment of an LED lighting device for executing the sequences shown in FIG. 1.

FIG. 2 sketches out a lighting device L, which includes a control device T, especially a driver, for operating light emitting diodes LD1, LD2 and LD3. The light emitting diodes are divided up into three strands, which correspond to a respective color channel Ch1, Ch2 or Ch3. Each color channel contains one or more light emitting diodes LD1, LD2 or LD3 of the same color, e.g. the color channel Ch1 the red light emitting diodes LD1, the color channel Ch2 the green light emitting diodes LD2 and the color channel Ch3 the blue light emitting diodes LD3. The color channels Ch1, Ch2 and Ch3 are each able to be controlled separately or individually by means of a control device T. The color channels Ch1, Ch2 and Ch3 can for example contain the light emitting diodes LD1, LD2 or LD3 in a series circuit. The number of light emitting diodes LD1, LD2 and LD3 can differ.

An LED LD1, LD2, LD3 can be understood as an individually housed LED or an LED chip. Light emitting diodes LD1, LD2, LD3 embodied as LED chips can for example be arranged on a common substrate. LEDs LD1, LD2, LD3 can for example be inorganic LEDs, e.g. with InGAlP or organic LEDs (OLEDs).

While a greater portion of the light radiated by the LEDs LD1, LD2 and LD3 is emitted externally, a smaller portion falls on a photodetector D. A signal output of the photodetector D is functionally connected to the control device T, where a sensor signal output by the signal output can be evaluated.

During an operating phase BP1, BP2 the sensor signal of the photodetector D can be used for example to regulate the current which flow through the color channels Ch1, Ch2 and Ch3, so that a setpoint value of a luminous flux can be adhered to. As an alternative the photo detector D can be not used in the operating phase BP1, BP2.

The measurement phase MP can be used especially for a calibration of the lighting device L. Thus for example a correlation between a current through a color channel Ch1, Ch2 and Ch3 and the luminous intensity or luminous flux of this color channel Ch1, Ch2 or Ch3 produced by said current can be determined. With this in its turn a desired color location and/or a desired luminous intensity can be set or regulated more precisely during the operating phases BP1, BP2 for example.

The control device T can functionally comprise a switchover device for switching over the LED lighting device from the operating phase BP1, BP2 into the measurement phase MP and back again and also a measurement phase scheduler.

Naturally the present invention is not restricted to the exemplary embodiment shown.

Thus, instead of or in addition to a pulse width-modulated control of the color channels, there can also be a current level-modulated or current strength-modulated control of the color channels.

In a possible variant the color channels can then each be operated in continuous operation, wherein their luminous intensity can be set by a current level or current strength of an operating current injected into the respective color channel.

Then in the measurement phase the color channels can be controlled successively each with the same current strength or current level as in the operating phase, wherein different color channels can also preferably be controlled for the same length of time for a color impression uniform with the operating phase. This also makes possible an especially short measurement phase.

A current level variable control of the color channels is also possible, i.e. a PWM control, in which current level or current strength can additionally be varied.

If a current level is able to be set (with or without PWM activation), this can also be varied during the measurement phase, in order to optimize the sensor signal of the at least one photodetector.

Thus in the event of a luminous intensity striking the at least one photo detector being comparatively small and thus a signal-to-noise ratio (SNR) of the sensor signal also being comparatively small, the current level for this color channel can be increased until the sensor signal exhibits a smaller noise error or a higher SNR.

The current level can also be reduced for the case in which a luminous intensity striking the at least one photodetector is comparatively high and especially is within the saturation range of the at least one photodetector. In other words the luminous intensity here is already high enough for the photodetector to be saturated and, with a further increase in the luminous intensity, its sensor signal is not amplified any further. An indication that the photosensor is being operated beyond its saturation limit is the presence of a maximum sensor signal, e.g. a maximum sensor voltage.

In the event of a luminous intensity that is too high, the current level of the color channel can be reduced until such time as the associated sensor signal is in a range between a value just below the maximum sensor signal, as an upper limit, and above a value which already has a favorable SNR. It has proved advantageous for the current level of the color channel to be reduced until such time as the associated sensor signal is in a range between 50% and below, especially 99.5%, of the maximum sensor signal, especially between 75% and below, especially 99.5%, of the maximum sensor signal.

The search for a favorable sensor range can be carried out by means of a suitable search algorithm. Thus a linear search algorithm can be carried out in which the current level is increased in steps (linear) (for an initially too weak sensor signal) or lowered (for an initially too strong or saturated sensor signal). Such a search algorithm exhibits (in Landau notation) a complexity class of 0(n).

An even faster adaptation, e.g. with the complexity class 0(log n), can be achieved by other search algorithms, e.g. a binary search algorithm or an interpolation search or interval search.

In addition the sequence of the color channels activated successively temporally is basically not restricted. The sequence can be the same for a number of measurement phases (e.g. always Ch1, Ch2, Ch3) or can differ (e.g. Ch1, Ch2, Ch3 for one measurement phase and for example Ch3, Ch1, Ch2 for another measurement phase). In such cases the sequence is preferably generally selected so that the measurement phase is as short as possible. With the current sources usually used this is especially the case if the color channels are controlled in the measurement phase in descending order of brightness, i.e. first the color channel with the greatest brightness, then the channel with the second greatest brightness etc., through to the channel with the lowest brightness, since the usual current sources need significantly more time for an increase in power than for a decrease in power. As a conclusion the dark phase is then advantageous if such a phase is provided. This produces an especially rapid measurement and thus a short measurement phase which minimizes the danger of visible variations in brightness occurring for an observer. Should a current source be used which reacts more quickly when rising than when falling, naturally a measurement in the reverse order, i.e. from the darkest to the brightest color channel, is advantageous.

In general terms each of the color channels can be activated once or a number of times in a measurement phase. Thus in a measurement phase at least one of the channels can be activated twice; e.g. in one measurement phase the red, the green and the blue color channel can each be activated twice, e.g. in the order Ch1, Ch2, Ch3, Ch1, Ch2, Ch3. The control signals for the color channels can follow each other directly or be spaced apart in time.

The scope of protection of the invention is not limited to the examples given hereinabove. The invention is embodied in each novel characteristic and each combination of characteristics, which includes every combination of any features which are stated in the claims, even if this feature or combination of features is not explicitly stated in the examples.

The invention claimed is:

1. A method of operating an LED lighting device having at least two color channels, wherein each color channel comprises at least one LED, the LEDs of a color channel each have the same color, and each color channel is configured to be activated separately, and at least one photodetector, which is configured and arranged to detect a portion of the light radiated by the LEDs, the method comprising:

switching over the LED lighting device from an operating phase into a measurement phase, wherein, in the measurement phase, the LEDs radiate sufficient light so that a current signal level of the at least one photodetector lies in a range from 75% to less than 100% of a peak current signal level of the at least one photodetector;

activating temporally consecutively the color channels so that a light radiated during the measurement phase by the LEDs has an integral mixture that substantially corresponds to a color mixture of the operating phase, wherein, during the measurement phase, each color channel is activated separately by a pulse width modulation so that a ratio of pulse widths of the color channels during the measurement phase substantially corresponds to a ratio of the pulse widths of the color channels during the operating phase.

2. The method of claim 1, wherein a deviation of a ratio of the pulse width of two color channels during the measurement phase does not deviate by more than 10% from the ratio of the pulse width of these two color channels during the operating phase.

3. The method of claim 2, wherein the deviation is not more than 1%.

4. The method of claim 1, further comprising setting a current level separately for each color channel so that a ratio of current levels of the current levels during the measurement phase substantially corresponds to a ratio of the current levels of the color channels during the operating phase.

5. The method of claim 4, wherein the amount of light is set to the value by means of a search algorithm.

6. The method of claim 5, wherein the search algorithm is a binary search algorithm.

7. The method of claim 1, wherein the measurement phase includes turning off all color channels.

8. The method of claim 1, wherein the measurement phase includes compensation periods during which the color channels are activated as during an operating phase.

9. The method of claim 1, wherein the measurement phase lasts no longer than about 40 ms.

10. The method of claim 9, wherein the measurement phase lasts no longer than about 10 ms.

11. The method of claim 1, wherein a period of time between two measurement phases is not constant.

12. The method of claim 1, wherein a sensor signal output during the measurement phase by the at least one photodetector is used at least in sections to adapt an activation in a following operating phase.

13. The method of claim 1, further comprising, activating the color channel in the measurement phase in a sequence of a brightness of the color channels.

14. The method of claim 13, further comprising activating the color channel in the measurement phase in sequence by ascending order of the brightness of the color channels.

15. The method of claim 1, wherein the two color channels are of different colors.

16. An LED lighting device, comprising:

at least two color channels, wherein each color channel comprises at least one LED of the same color and wherein each color channel is configured to be activated separately;

at least one photodetector, which is configured and arranged to detect a portion of the light radiated by the LEDs; and a control device comprising:

a switchover device for switching over the LED lighting device from an operating phase into a measurement phase; and a measurement phase scheduler, configured to activate the color channels one after another, wherein the control device is configured to cause the switchover device to switch over the LED lighting device from the operating phase into the measurement phase, and temporally consecutively activate the color channels so that a light radiated by the LEDs during the measurement phase has an integral color mixing that substantially corresponds to a color mixing of the operating phase, wherein the control device is configured to cause the LEDs during the measurement phase to radiate sufficient light so that a current signal level of the at least one photodetector lies in a range from 75% to less than 100% of a peak current signal level of the at least one photodetector, and wherein the control device is configured to activate each color channel separately during the measurement phase by a pulse width modulation so that a ratio of pulse widths of the color channels during the measurement phase substantially corresponds to a ratio of the pulse widths of the color channels during the operating phase.

17. The LED lighting device of claim 16, wherein a deviation of a ratio of the pulse width of two color channels during the measurement phase does not deviate by more than 10% from the ratio of the pulse width of these two color channels during the operating phase.

18. The LED lighting device of claim 16, wherein the control device is configured to set a current level separately for each color channel so that a ratio of current levels of the current levels during the measurement phase substantially corresponds to a ratio of the current levels of the color channels during the operating phase.

* * * * *